US010662669B2

(12) United States Patent
Anderson

(10) Patent No.: US 10,662,669 B2
(45) Date of Patent: May 26, 2020

(54) ANCHOR FENCE POST ASSEMBLY

(71) Applicant: Kenneth Curt Anderson, Pincher Creek (CA)

(72) Inventor: Kenneth Curt Anderson, Pincher Creek (CA)

( * ) Notice: Subject to any disclaimer, the term of this patent is extended or adjusted under 35 U.S.C. 154(b) by 555 days.

(21) Appl. No.: 15/657,375

(22) Filed: Jul. 24, 2017

(65) Prior Publication Data

US 2018/0038129 A1 Feb. 8, 2018

Related U.S. Application Data

(60) Provisional application No. 62/370,280, filed on Aug. 3, 2016.

(51) Int. Cl.

| | |
|---|---|
| ***E04H 17/08*** | (2006.01) |
| ***E04H 17/20*** | (2006.01) |
| ***E04H 17/24*** | (2006.01) |
| ***E04H 17/14*** | (2006.01) |

(52) U.S. Cl.

CPC ..... *E04H 17/08* (2013.01); *E04H 17/20* (2013.01); *E04H 17/24* (2013.01); *E04H 2017/1447* (2013.01)

(58) Field of Classification Search

CPC ..... E04H 17/02; E04H 17/04; E04H 17/06; E04H 17/08; E04H 17/10; E04H 17/12; E04H 17/20; E04H 17/22; E04H 17/24

See application file for complete search history.

(56) References Cited

U.S. PATENT DOCUMENTS

| | | | | | |
|---|---|---|---|---|---|
| 891,246 | A * | 6/1908 | Grissom | E04H 17/08 | 256/35 |
| 1,317,073 | A * | 9/1919 | Carlson | E04H 17/22 | 52/150 |
| 1,811,217 | A * | 6/1931 | Spaugh | E04H 17/08 | 52/151 |
| 1,828,350 | A * | 10/1931 | Williams | E04H 17/08 | 256/35 |
| 2,044,053 | A * | 6/1936 | Brock | E04H 17/08 | 52/149 |
| 4,349,181 | A * | 9/1982 | Asher | E04H 17/08 | 256/22 |
| 4,479,636 | A * | 10/1984 | King | E04H 17/08 | 256/22 |
| 4,619,440 | A * | 10/1986 | Thevenin | E04H 17/12 | 256/47 |
| 4,705,262 | A * | 11/1987 | Roberts | E04H 17/26 | 254/263 |

(Continued)

*Primary Examiner* — Jonathan P Masinick

(74) *Attorney, Agent, or Firm* — Ade & Company Inc; Ryan W. Dupuis

(57) ABSTRACT

A fence having a plurality of fence posts supported in the ground at spaced apart locations along the fenced boundary and fencing material joined to the fence posts under tension, further includes an anchor fence post assembly at a corner of the fence. The anchor fence post assembly has an anchor post for coupling the fencing material thereon. An anchor pin is penetrated into the ground such that the anchor pin extends along a post axis at an upward and outward slope which is offset from vertical away from a direction of tension of the fencing material. The anchor post that couples the fencing material thereon is slidable along the post axis relative to the anchor pin.

20 Claims, 6 Drawing Sheets

(56) References Cited

U.S. PATENT DOCUMENTS

| | | | | | |
|---|---|---|---|---|---|
| 5,139,235 | A * | 8/1992 | Kilmer | E02D 5/801 | 256/35 |
| 5,460,344 | A * | 10/1995 | Malloy | E04H 17/22 | 248/156 |
| 5,697,600 | A * | 12/1997 | Fingerson | E04H 17/22 | 256/64 |
| 5,996,973 | A * | 12/1999 | Campbell | E01F 9/685 | 256/31 |
| 6,126,147 | A * | 10/2000 | Fingerson | E04H 12/2223 | 256/64 |
| 6,209,853 | B1 * | 4/2001 | Roy | A01K 3/005 | 174/158 F |
| 6,866,252 | B2 * | 3/2005 | Pulliam | A01K 3/00 | 256/35 |
| 8,458,966 | B2 * | 6/2013 | O'Toole | E04H 17/22 | 52/146 |
| 8,480,061 | B2 * | 7/2013 | Graves | E04H 17/20 | 248/220.21 |
| 9,295,224 | B2 * | 3/2016 | Arden | A01K 3/00 | |
| 9,314,652 | B2 * | 4/2016 | Broadley | A62B 1/06 | |
| 9,732,540 | B1 * | 8/2017 | Jansen | E04H 17/22 | |
| 10,036,180 | B1 * | 7/2018 | Jansen | E04H 17/22 | |

* cited by examiner

ANCHOR FENCE POST ASSEMBLY

This application claims the benefit under 35 U.S.C. 119(e) of U.S. provisional application Ser. No. 62/370,280, filed Aug. 3, 2016.

FIELD OF THE INVENTION

The present invention relates to an anchor fence post assembly for use at an end or in a corner of a fence structure having fencing material spanning under tension between spaced apart fences posts, and more particularly the present invention relates to an anchor fence assembly including an anchor post for anchoring the fencing material thereon and an anchor pin which is penetrated into the ground at an upwardly and outward slope upon which the anchor post is slidably supported.

BACKGROUND

In traditional barb wire and electric wire fences, the anchor or corner posts are pulled by the wire tension and ever changing environment which affects the ground conditions into which the posts are installed. Efforts have been made to reinforce anchor posts (for example corner posts, end posts, gate posts, etc.) by providing two parallel posts joined as a double post assembly; however, in this instance, the inside post acts as a lever or fulcrum to lift the outside post upwardly out of the ground over time. This heaving pulls apart the joining structure between the double posts.

U.S. Pat. No. 4,479,636 by King, U.S. Pat. No. 891,246 by Grissom, and U.S. Pat. No. 4,705,262 by Roberts disclose various examples of angled brace structures relating generally to fencing. A similar problem occurs which using angle braces to secure a single anchor fence post because the angle brace also acts as a lever or fulcrum relative to which the anchor post is heaved upwardly out of the ground over time. This requires frequently driving the posts back into the ground before the posts are sufficient heaved to reach a failure point. Either one of the frequent re-driving of the posts or the reassembly of the structure after failure is labor intensive and desirable to be avoided.

SUMMARY OF THE INVENTION

According to one aspect of the invention there is provided an anchor fence post assembly for a fence including a plurality of fence posts supported in the ground at spaced apart locations along a fenced boundary and fencing material joined to the fence posts under tension so as to extend along the fenced boundary, the fence post assembly comprising:

a frame including a base having a bottom side arranged to be engaged upon a surface of the ground and an anchor post fixed relative to the base for coupling the fencing material thereon;

the anchor post extending non-perpendicularly upwardly from a plane of the bottom side of the base such that a post axis of the anchor post is arranged to extend upwardly at an outward slope away from a direction of tension of the fencing material when the bottom side of the base is engaged substantially horizontally upon the surface of the ground; and an anchor pin arranged to be penetrated into the ground along the post axis and coupled to the frame such that the frame is slidable relative to the anchor pin and the ground along the post axis.

According to a second aspect of the present invention there is provided a fence for extending along a fenced boundary, the fence comprising:

a plurality of fence posts supported in the ground at spaced apart locations along a fenced boundary;

a fencing material joined to the fence posts so as to extend under tension along the fenced boundary; and an anchor fence post assembly comprising:

a frame including a base having a bottom side engaged upon a surface of the ground and an anchor post fixed relative to the base which couples the fencing material thereon, the anchor post extending non-perpendicularly upwardly from a plane of the bottom side of the base such that a post axis of the anchor post is oriented to extend upwardly at an outward slope away from tension of the fencing material with the bottom side of the base being engaged substantially horizontally upon the surface of the ground; and an anchor pin arranged to be penetrated into the ground along the post axis and coupled to the frame such that the frame is slidable relative to the anchor pin and the ground along the post axis.

According to a further aspect of the present invention there is provided a method of supporting a fence which includes a plurality of fence posts supported in the ground at spaced apart locations along the fenced boundary and fencing material joined to the fence posts so as to extend along the fenced boundary under tension, the method comprising:

providing an anchor fence post assembly on the fenced boundary spaced apart from the fence posts which includes an anchor post for coupling the fencing material thereon and an anchor pin for anchoring the anchor post relative to the ground;

penetrating the anchor pin into the ground such that the anchor pin extends along a post axis at an upward and outward slope which is offset from vertical away from a direction of tension of the fencing material;

supporting the anchor post on the anchor pin such that the anchor post is slidable along the post axis relative to the anchor pin; and coupling the fencing material to the anchor post.

The present invention provides a one-piece frame which incorporates the anchor post and which sits on the ground to be anchored by an anchor pin pushed down through the inclined anchor post to hold the position of the anchor post opposite to the tension forces from the wire fencing material. The tension of the wire fencing material pulls inwards, to urge the frame of the anchor post downwardly into the ground due to the slope of the anchor pin along which the frame is slidable. The free sliding support of the frame on the anchor pin ensures that tension of the wire maintains the frame of the anchor post held snugly against the upper surface of the ground even in the event of the anchor pin being heaved upwardly from the ground due to frost and thaw cycles of the ground for example. The design of the anchor post assembly thus ensures that the wire tension pulls the anchor post down against the upper surface of the ground. The anchor pin can be readily reset by pounding penetration into the ground by insertion fully through the hollow, open-ended anchor post. The anchor post assembly is readily portable and can be used in both permanent or temporary installations due to the ability to be readily moved and reused as desired. The anchor post assembly is best suited for use with barbwire or electric fence wire to provide an instant fence anchor by driving the anchor pin into the ground. The anchor pin is arranged to be readily penetrated into the ground with pushing, vibrating, pounding or drilling for example such that no digging is required to set the anchor fence post assembly, thus providing a considerable savings in time and labor relative to prior art anchor post configurations.

Preferably the anchor post comprises a hollow tube receiving the anchor pin slidably through opposing open ends of the hollow tube.

The base may include i) a base member extending outwardly from a bottom end of the anchor post within a plane lying at an obtuse angle to the anchor post such that the base member is engaged substantially horizontally on a surface of the ground when the anchor post is slidably supported on the anchor pin; and ii) a pair of side members protruding outwardly in laterally opposing directions at a bottom end of the anchor post so as to be engaged upon a surface of the ground at laterally opposing sides of a vertical plane containing the anchor post therein when the anchor post is slidably supported on the anchor pin.

When the fencing material comprises a plurality of fence wires spanning under tension at different elevations, preferably the anchor fence post assembly comprises a plurality of wire mounting locations formed on the anchor post at spaced positions along the anchor post upon which respective ones of the fence wires are supported at the different elevations.

The anchor fence post assembly may further include an auxiliary post mounted at an outer side of the anchor post and oriented transversely to the anchor post such that the auxiliary post is arranged to be vertically oriented within a common vertical plane with the anchor post when the anchor post is slidably supported on the anchor pin. Preferably a bottom end of the auxiliary post and a bottom end of the anchor post lie in common horizontal plane defining the bottom side of the frame.

The auxiliary post preferably also comprises a hollow tube extending between opposing open ends such that the anchor fence post assembly may optionally further include an auxiliary pin arranged to be slidably received through the hollow tube of the auxiliary post and penetrated into the ground to secure the auxiliary post relative to the ground.

The frame of the anchor fence post assembly may also include a plurality of crossbars within a common plane of the auxiliary post and the anchor post which connect between the auxiliary post and the anchor post at respective different elevations. When the fencing material comprises a plurality of fence wires spanning under tension at different elevations, each fence wire may be supported on the anchor post at an intersection of a respective one of the crossbars with the anchor post.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
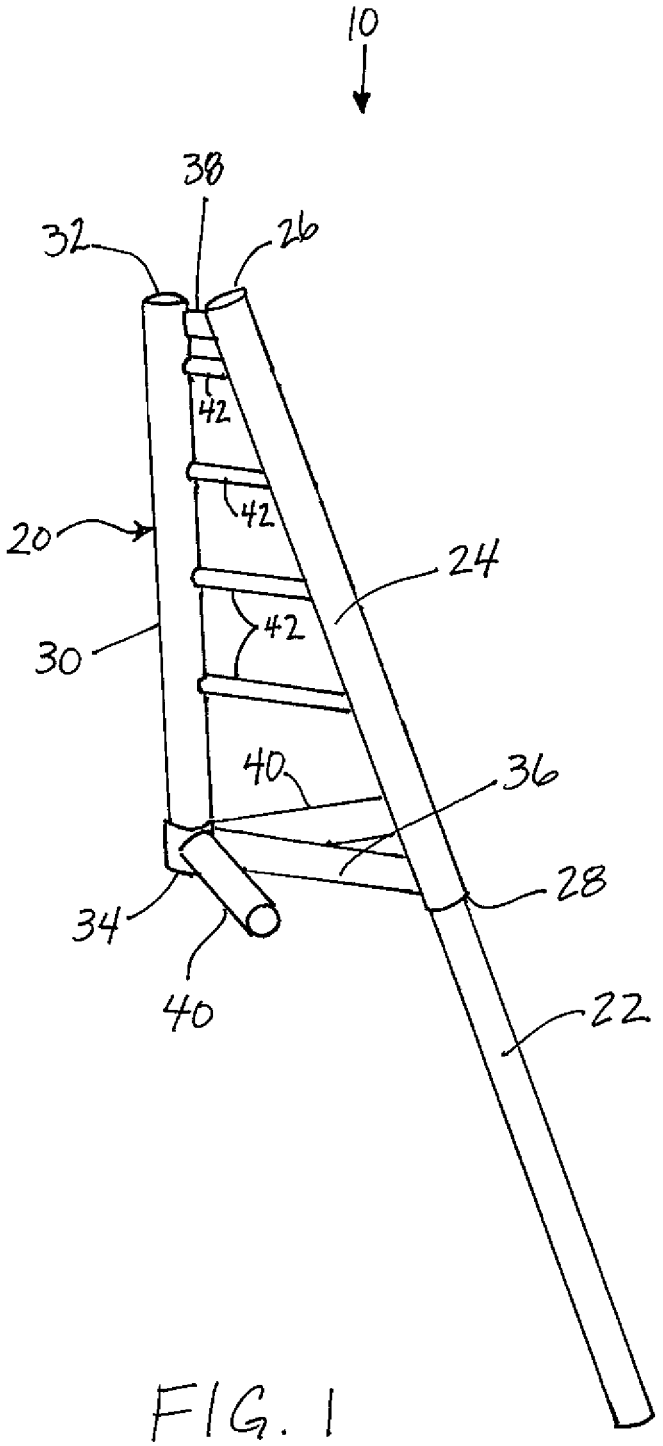
FIG. 1 is perspective view of the anchor fence post assembly according to a first embodiment the present invention.

Referring to the accompanying figures, there is illustrated an anchor fence post assembly generally indicated by reference numeral 10. The anchor fence post assembly is particularly suited for use as an intermediate corner fence post, a terminal corner fence post, or a gate fence post in a fence 12 installed in the ground along a fenced boundary.

Typically, the fence 12 comprises a plurality of fence posts 14 partially inserted into the ground at spaced positions along the fenced boundary. Fencing material is provided in the form of a plurality of fence wires 16 which span horizontally under tension along the fenced boundary between adjacent ones of the fence posts at respective different elevations along the fence posts relative to the ground.

The anchor fence post assembly 10 generally comprises a rigid frame 20 upon which the fence wires 16 are secured and an anchor pin 22 which is partially embedded in the ground to support the rigid frame 20 relative to the ground such that the frame is free to float relative to the anchor pin 22 and the ground and thereby resist upward heaving of the frame even if the anchor pin 22 is heaved upwardly from frost and thaw cycles of the ground for example.

The rigid frame 20 includes anchor post 24 in the form of a hollow tube which extends along a post axis between an open top end 26 at a top side of the frame and an opposing open bottom end 28 at the bottom side of the frame. The anchor post 24 is oriented non-perpendicularly to a plane of the bottom side of the frame such that the post and the post axis extend upwardly at a laterally outward slope, for example at an obtuse angle of approximately 70 degrees relative to the bottom side of the frame, so as to be offset approximately 20 degrees from vertical when installed.

The rigid frame 20 further includes an auxiliary post 30 at an outer side of the frame opposite the anchor post 24 at the inner side. The auxiliary post 30 is perpendicularly oriented relative to the plane of the bottom side of the frame so as to be vertically oriented when the bottom side of the frame is supported against a horizontal ground surface in use. The auxiliary post 30 also comprises a hollow tube which extends along respective linear axis between an open top end 32 at the top side of the frame and an opposing open bottom end 34 at the bottom side of the frame. The bottom sides of the two posts thus commonly lie in the horizontal plane at the bottom side of the frame.

The rigid frame 20 further includes a base at the bottom end of the posts which defines the plane of the bottom side of the frame. The base includes a base member 36 in the form of a horizontally oriented hollow tube which is welded between the bottom end of the anchor post and the bottom end of the auxiliary post to define a portion of the bottom side of the rigid frame. The bottom side of the base member is abutted directly against an upper surface of the ground in the installed position of the anchor fence post assembly.

The base member 36 supports the bottom ends of the two posts spaced apart from one another while lying in a common vertical plane with the two posts in the installed orientation of the anchor fence post assembly. Due to the slope of the anchor post, the anchor post extends upwardly at an outward slope towards the auxiliary post at the outer side of the frame such that the top ends of the two posts are closer to one another in distance than the respective bottom ends. A top member 38 connects horizontally between the top ends of the two posts, parallel and spaced above the base member 36 while lying in the same common vertical plane as the two posts.

The base at the bottom end of the rigid frame 20 further includes two side members 40 which protrude radially outward from the bottom end of the auxiliary post 30 in generally laterally opposing directions so as to protrude outwardly from opposing sides of the common vertical plane locating the two posts therein. Each side number 40 is a rigid, round tube extending laterally outwardly from the vertical plane of the posts at the bottom end of the auxiliary post at an inward inclination towards the anchor post at the inner side of the frame so as to be oriented at a slope of approximately 45° to the vertical plane locating the two posts therein. The side members remain in the common horizontal plane defining the bottom side of the rigid frame which locates the base member 36 therein.

The rigid frame 20 further includes a plurality of crossbars 42 which are rigidly joined between the anchor post and the auxiliary post at respective different elevations. The crossbars are generally horizontally oriented and evenly spaced apart in elevation such that each crossbar corresponds to the elevation of a respective one of the fence wires of the assembled fence. Each fence wire of the fence is positioned to be inserted between the anchor post and the auxiliary post at a location directly above a respective one of the crossbars. The anchor fence post assembly is typically positioned such that tension of the fence wires is oriented inwardly against the outer side of the anchor post that faces outwardly towards the auxiliary post. The downward and inward slope of the anchor post also ensures that the inward tension of the fence wires directs the fence wire into positive engagement with the top side of the respective crossbar associated therewith at the intersection of the crossbar with the anchor post. In the installed position of the anchor fence post assembly with the bottom side of the frame abutted with an upper surface of the ground, the inward tension on the fence wires thus acts to pull the anchor post downwardly and inwardly along the sloped post axis of the anchor post to maintain firm engagement of the rigid frame with the upper surface of the ground.

To maintain position of the rigid frame along the fenced boundary, the anchor pin 22 is slidably inserted through the anchor post along the post axis such that the bottom end of the anchor pin is penetrated into the ground. The anchor pin 22 is an elongate, linear, rigid bar of material which may be solid or hollow along the length thereof and which has an outer diameter which closely fits within the inner diameter of the hollow anchor post to be slidable fully through the anchor post. Length of the anchor pin along the post axis is typically much greater than the overall length of the anchor post such that the anchor pin can be partially embedded into the ground while the remaining portion of the anchor pin protruding from the ground spans the full height of the anchor post. The anchor pin is embedded into the ground and inserted through the hollow of the anchor post such that the rigid frame remains freely slidable along the anchor pin in the direction of the post axis. The anchor pin ensures that the movement of the rigid frame is limited to a movement along the anchor pin. The inward tension applied by the fence wires thus directs the rigid frame downwardly along the anchor pin into firm engagement with the upper surface of the ground but horizontal translation of the rigid frame across the surface of the ground is prevented by the mating connection of the anchor pin slidably received through the anchor post.

In the event of any upward heaving of the anchor pin from the ground, the free sliding movement of the rigid frame along the anchor pin causes the tension in the fence wires to pull the rigid frame downwardly along the post axis relative to the anchor pin to maintain firm engagement of the rigid frame with the upper surface of the ground. The rigid frame supporting the fence wires thereon is thus not heaved upwardly together with upward heaving of the anchor pin for example as a result of freeze and thaw cycles of the ground.

In some instances, it may be desirable to further secure the rigid frame relative to the ground by also providing an auxiliary pin 44 which is substantially identical in configuration to the anchor pin 22 with an outer diameter which closely fits within the inner diameter of the hollow auxiliary post 30. In this manner the auxiliary pin 44 can be vertically and slidably inserted downwardly through the open top end of the auxiliary post for subsequent penetration of the bottom end of the auxiliary pin 44 into the ground until the auxiliary pin is at least partially embedded in the ground but the protruding portion of the auxiliary pin spans substantially the full height of the auxiliary post 30 between the bottom end and the top end thereof. The auxiliary pin 44 can be embedded into the ground by various techniques of hammering or pounding for example similarly to the anchor pin 22.

Figure 2:
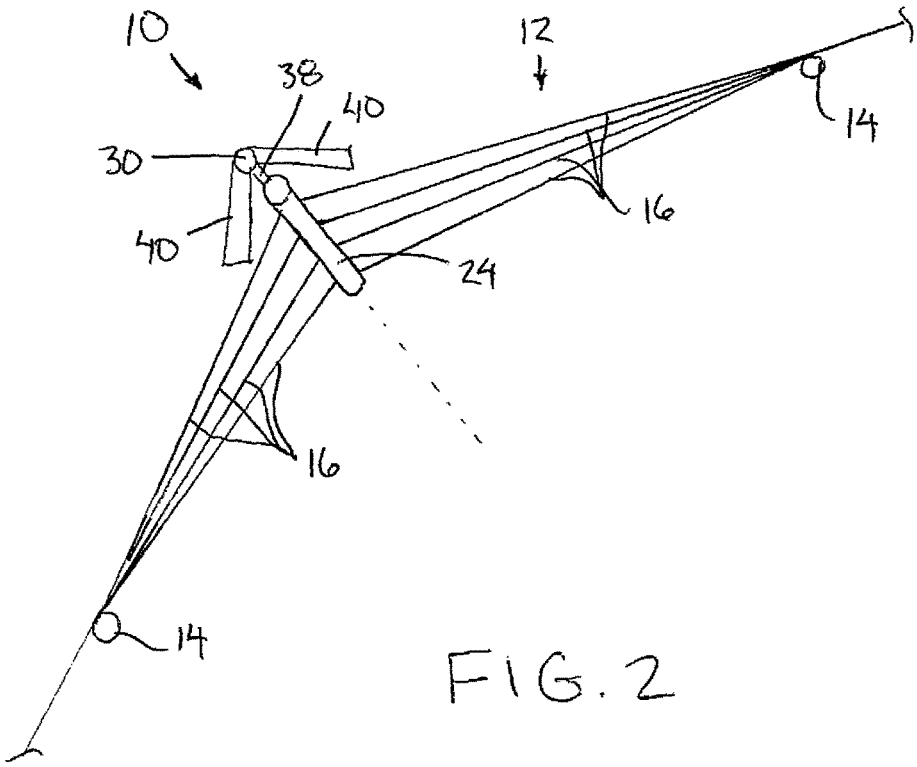
FIG. 2 is a top plan view of a fence incorporating the anchor fence post assembly according to FIG. 1 therein as an intermediate corner post.
Figure 3:
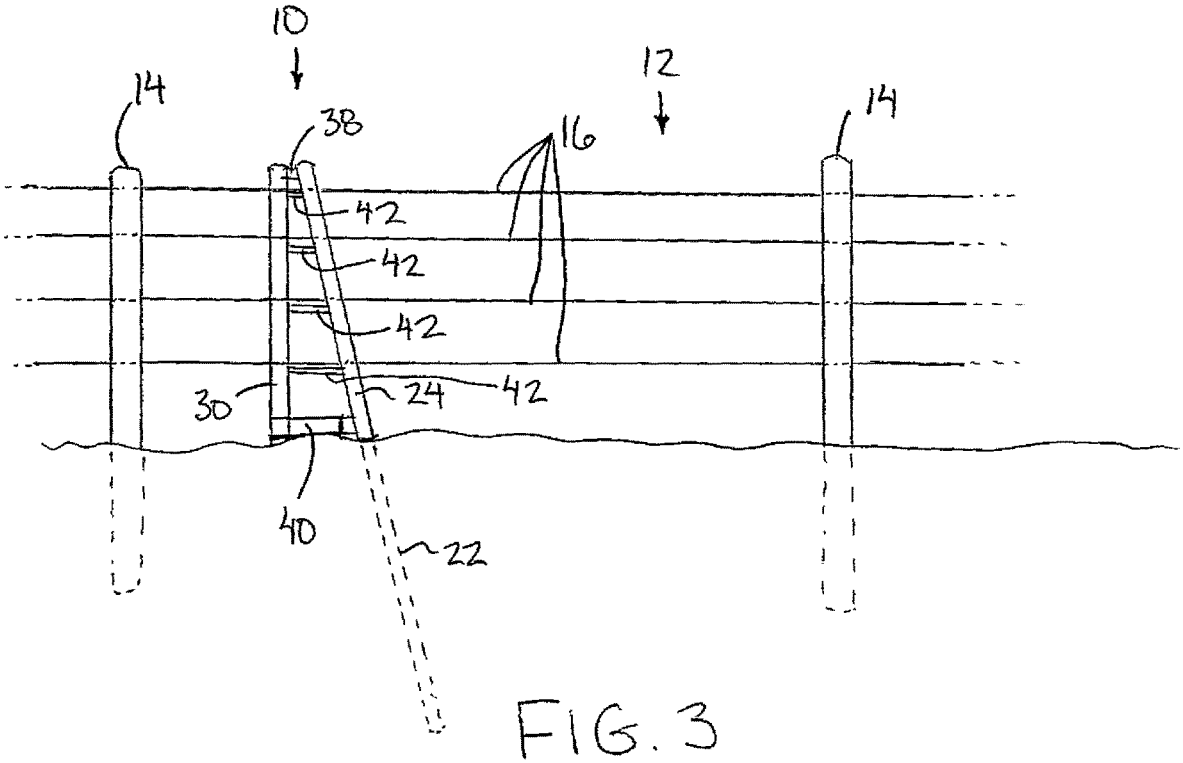
FIG. 3 is an elevational view of the fence according to FIG. 2.
Figure 4:
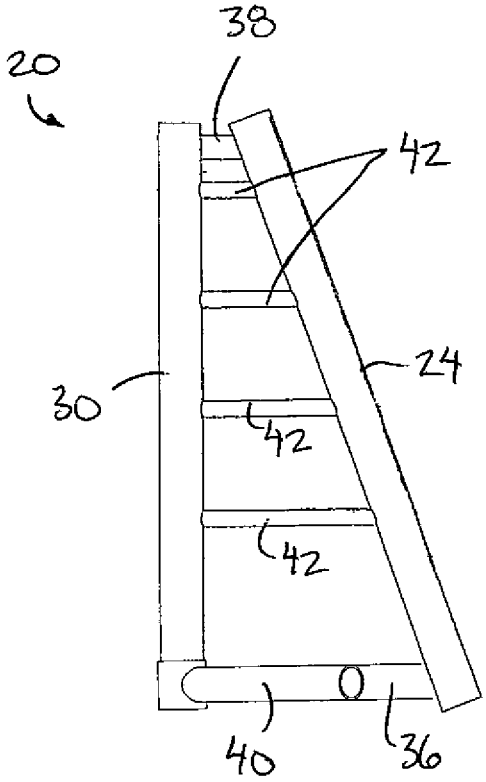
FIG. 4 is a side elevational view of the anchor fence post assembly according to FIG. 1.
Figure 5:
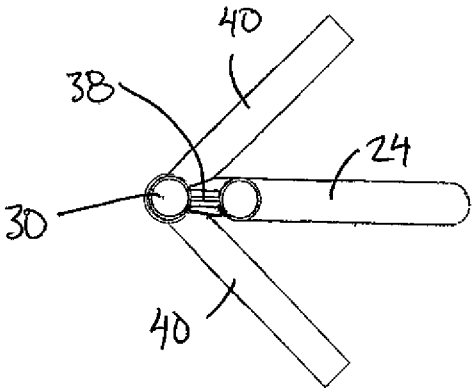
FIG. 5 is a top plan view of the frame of the anchor fence post assembly according to FIG. 1.

The anchor fence post assembly 10 can be used at various locations along a fenced boundary. As shown in FIGS. 2 and 3 for example, the anchor fence post assembly can be used as an intermediate corner post at an intermediate location along the fencing material between two of the fence posts. In this instance the fencing material typically forms an interior angle of less than 180° at the corner location of the intermediate corner post by bending the fence wires around the outer side of the anchor post. The vertical plane of the auxiliary post 30 and the anchor post 24 in this instance is oriented to bisect the interior angle formed by the fencing material.

Figure 6:
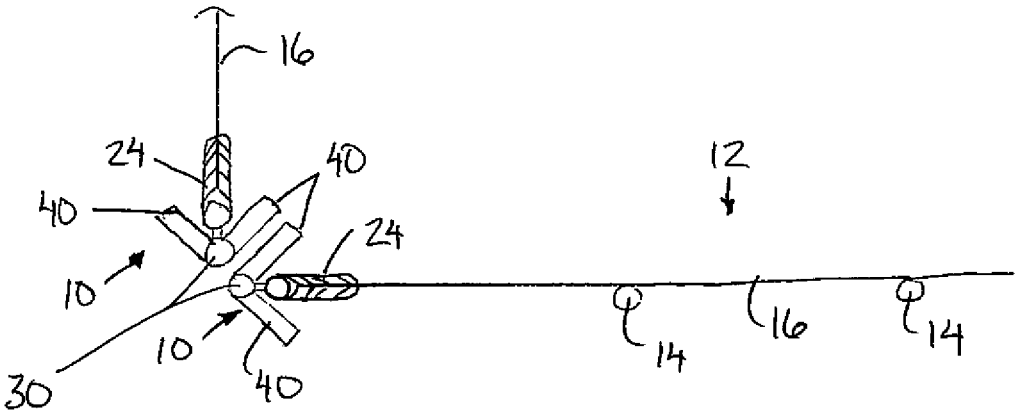
FIG. 6 is a top plan view of a fence incorporating the anchor fence post assembly according to FIG. 1 therein as a terminal corner post.

Alternatively, as shown in FIG. 6, the anchor fence post assembly can be used as a terminal corner post. In this instance terminal ends of the fence wires forming the fencing material are secured to the anchor post and the vertical plane of the auxiliary post 30 and anchor post 24 is oriented to be parallel or coplanar with the fence wires spanning between the anchor fence post assembly and the next adjacent fence post. Two terminal corner posts from two adjacent sections of fence may be located directly adjacent one another by positioning the two auxiliary posts in close proximity to one another. In this instance, the crossbars 42 provide the function of closing the gap between the auxiliary post and the anchor post to prevent escape of animals from the fenced area therethrough for example. Additional rigid bars may be provided to span across the gap between the two posts to yet further resist the passage of small animals therethrough as may be desired.

Figure 7:
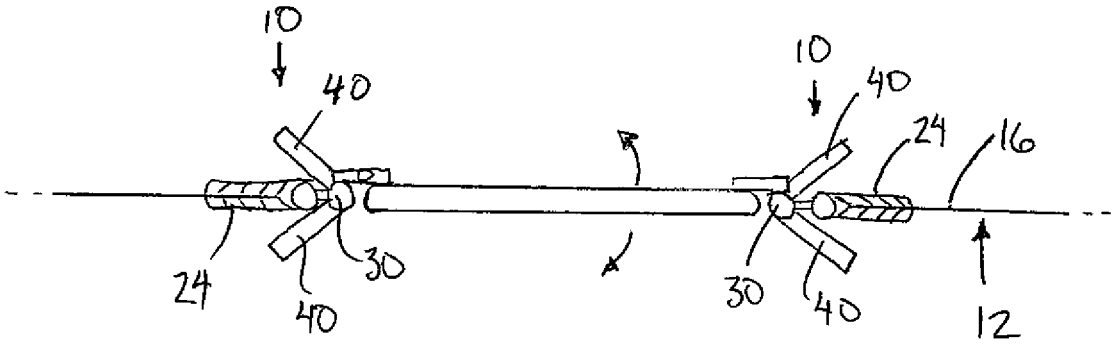
FIG. 7 is a top plan view of a fence incorporating the anchor fence post assembly according to FIG. 1 therein as a gate post.
Figure 8:
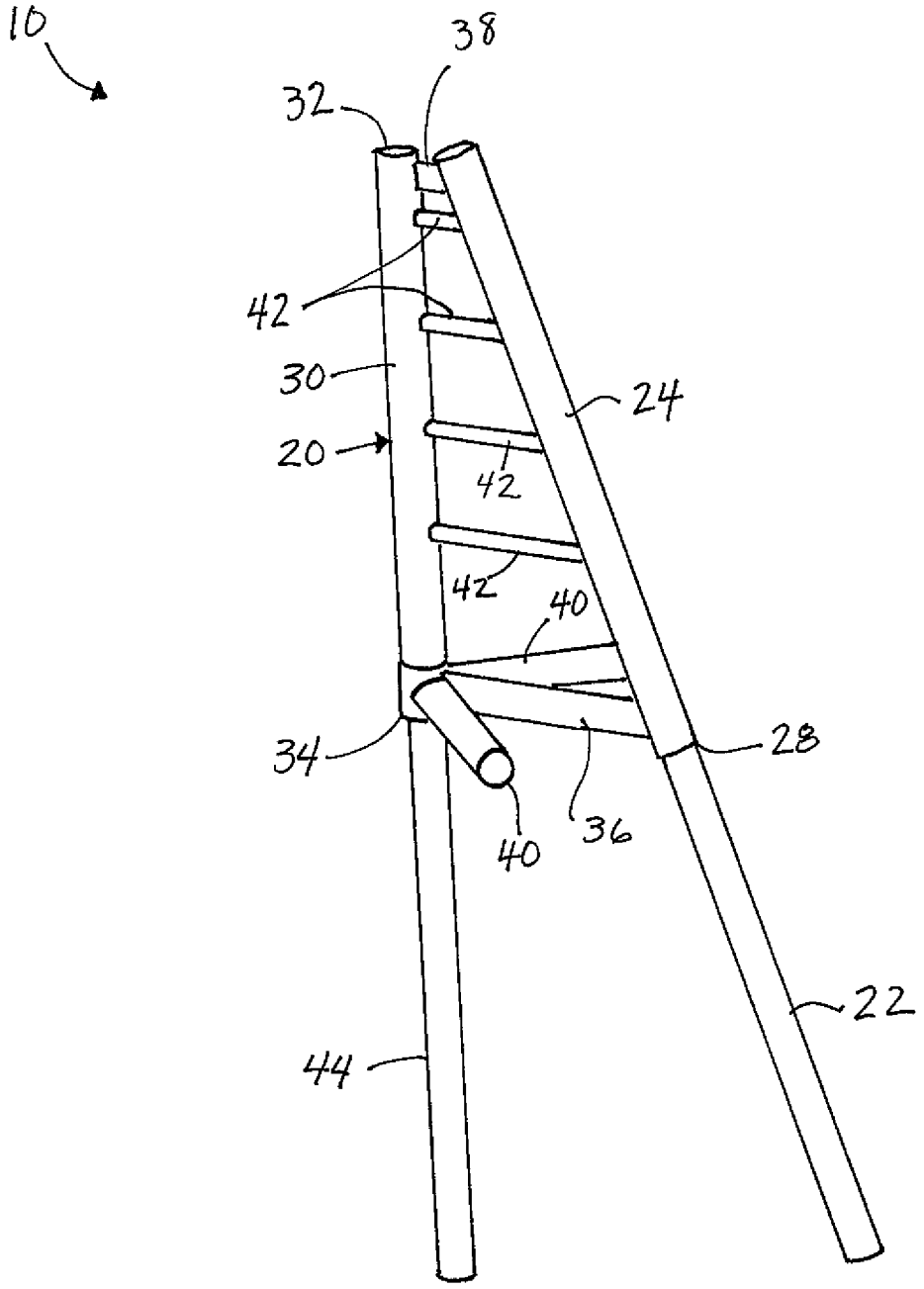
FIG. 8 is a perspective view of the corner fence post assembly according to FIG. 1 shown with an optional auxiliary pin supporting the frame thereon relative to the ground.

The anchor fence post assembly 10 can also be used as a gate post as shown in FIG. 7. In this instance the terminal ends of the fence wires are anchored about the anchor post while the vertical plane of the anchor post and auxiliary post is again oriented to be parallel and coplanar with the fence wires spanning to the next adjacent fence post in a manner which is substantially identical to the configuration of the terminal corner post for example.

The anchor post assembly can be used with varying lengths of the anchor pins to be embedded two different depths in the ground according to different ground conditions encountered. In addition, the auxiliary pin 44 can be used optionally depending upon ground conditions and the desirability for additional reinforcing.

Figure 9:
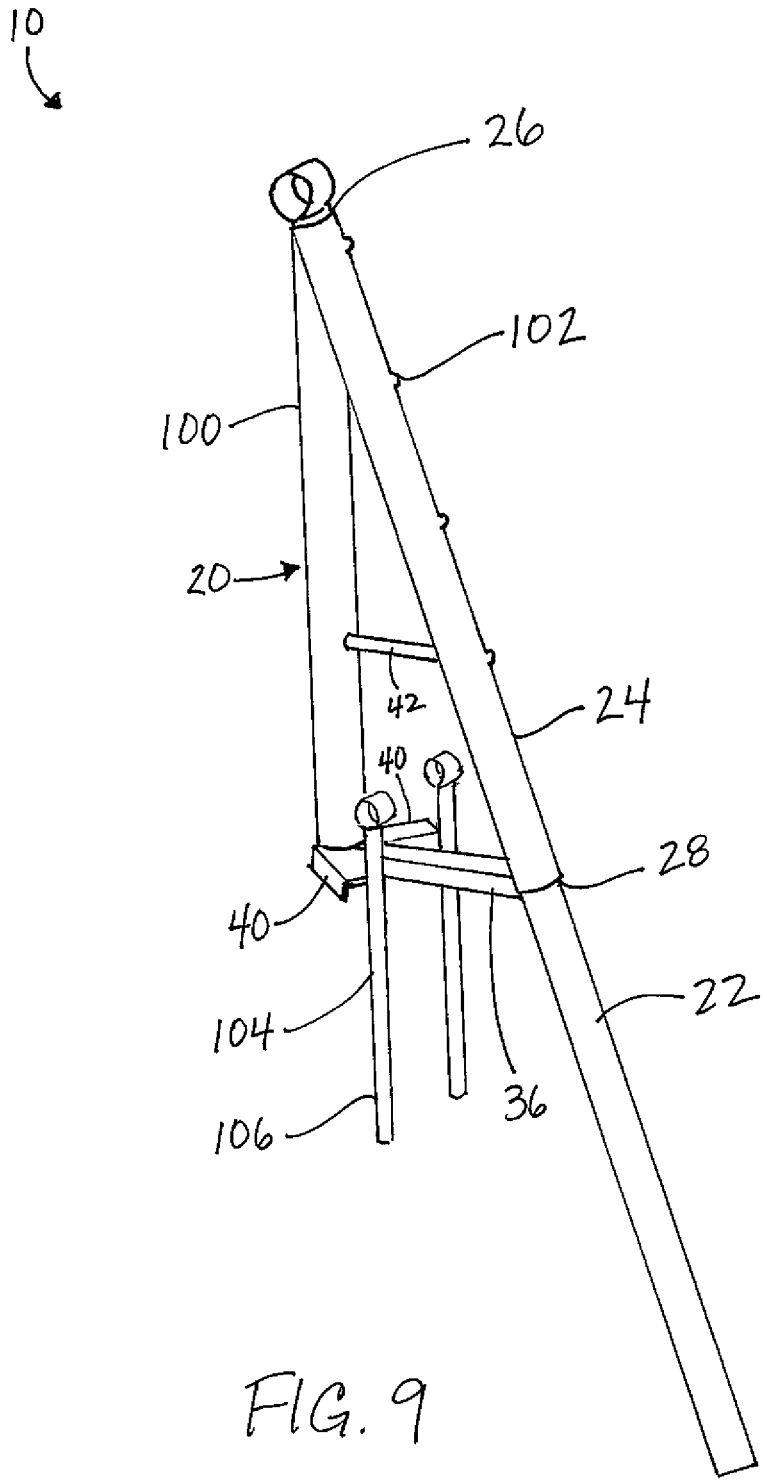
FIG. 9 is a perspective view of a further embodiment of the corner fence post assembly.

In instances where the auxiliary pin 44 is not required, the rigid frame 20 of the anchor fence post assembly 10 may be reconfigured such that there is no hollow auxiliary post 30 able to receive an auxiliary pin 44 therethrough. As shown in FIG. 9 according to a further embodiment of the rigid frame, an outer post 100 may be provided in place of the auxiliary post in which the top end of the outer post is directly connected to the top end of the anchor post to minimize the horizontal gap between the two posts. In this instance less cross bracing is required between the two posts to close the gap between the posts. Additional wire anchors 102 may be provided at the inner side of the anchor post in this instance corresponding to the elevation of the fence wires in which each wire anchor comprises an eyelet receiving a respective one of the fence wires therein instead of wrapping each fence wire about the anchor post and relying on crossbars to position the fence wires as in the previous embodiment. Also as shown in the alternative embodiment of FIG. 9, the outer ends of the two side members 40 may also include stake apertures 104 therein to permit support stakes 106 to be inserted vertically through the stake apertures and penetrated into the ground for additional lateral stability of the rigid frame.

In yet further arrangements, the base of the frame may be varied so that additional support members are provided which protrude inwardly from the bottom end of the anchor post 24 in opposing lateral directions within the common horizontal plane of the base to provide further stability of the frame relative to the ground against the tension of the wires for example. These additional support members thus extend from the bottom of the anchor post 24 generally in the direction of the fence wires in opposing directions.

In either instance, use of the anchor fence post assembly typically involves positioning the rigid frame at a desired location along the fenced boundary, followed by penetration of the anchor pin into the ground by insertion downwardly through the hollow anchor post. The anchor pin thus fixes the positioning of the rigid frame relative to the ground while still enabling the rigid frame to float in elevation relative to the ground. The fence wires of the fencing material are secured to the anchor post and tension is applied to the wires such that the resulting inward tension applies an inward and downward force on the rigid frame along the post axis of the anchor post and anchor pin combination. The tension of the fence wires thus ensures the rigid frame containing the anchor post remains firmly engaged against the upper surface of the ground in the proper orientation relative to the ground and the remainder of the fence installed in the ground. In the event that the anchor pin heaves upwardly over time, the operator can simply pound the anchor pin back into the ground without any disconnection of the rigid frame from the fencing material being required and without tension being released from the fencing material connected to the rigid frame.

The frame and anchor pins of the fence post assembly 10 are typically made of steel, however, in lighter applications, the fence post assembly components could be made out of plastic (for example ABS), fibreglass, and/or various composite materials, including recycled materials for example.

The anchor fence post assembly 10 is advantageous as the frame structure can be readily built in the shop at any time and in any weather well before installation. Set up in the field is very quick and can be performed at any time, and in substantially any weather. The assembly is well suited to both permanent or temporary fencing installations as it is inexpensive, portable and readily reusable. A simple configuration can be used with a variety of different fencing applications including standard or electric wire fences at various locations including a gate post anchor, a corner post anchor, or an intermediate angled anchor, as well as cross fence anchors and three-way or four-way corner locations for example. In the illustrated embodiment, the anchor post is offset approximately 20° from vertical, however in further embodiments a range of various angles is envisioned including anchor posts which may be oriented at 5°, 10°, 15°, 25°, 30°, 35°, 40°, or 45° from vertical for example. The rigid frame can be pinned down with a single anchor pin or with two pins for more stability as may be required, for example when mounting gates or in unstable soils. The overall length of the pin can vary considerably such as 8 feet, 10 feet, 12 feet, 14 feet or more for varying ground conditions for example. The pins can be reset or exchanged with longer pins if frost heaving is found to be problematic or if the length is otherwise determined to be unsuitable for a particular soil condition. The wire attachment points above the crossbars provide gentle curves for the fence wires to follow which maximizes wire strength. The rigid frame is also suited for simple installation of a gate latch tightener thereon. The rigid frame can be built with various wire spacings and various post or pin diameters or heights, as well as different base configurations according to preferences of stability, ground conditions, material availability, and/or costs. Various accessories can be quickly and easily installed on any anchor post as all anchor posts are built to be identical in configuration regardless of the installation location. Examples of suitable accessories include wire loops, wire gate latches, gate ends and stays, steel gate hinges, and wire fix ties for example.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An anchor fence post assembly for a fence including a plurality of fence posts supported in the ground at spaced apart locations along a fenced boundary and fencing material joined to the fence posts under tension so as to extend along the fenced boundary, the fence post assembly comprising:

a frame including a base having a bottom side arranged to be engaged upon a surface of the ground and an anchor post fixed relative to the base for coupling the fencing material thereon;

the anchor post extending non-perpendicularly upwardly from a plane of the bottom side of the base such that a post axis of the anchor post is arranged to extend upwardly at an outward slope away from a direction of tension of the fencing material when the bottom side of the base is engaged substantially horizontally upon the surface of the ground; and an anchor pin arranged to be penetrated into the ground along the post axis and coupled to the frame such that the frame is slidable relative to the anchor pin and the ground along the post axis.

2. The assembly according to claim 1 wherein the anchor post comprises a hollow tube receiving the anchor pin slidably through opposing open ends of the hollow tube.

3. The assembly according to claim 1 when the base includes a base member extending outwardly from a bottom end of the anchor post at an obtuse angle to the anchor post to define the bottom side of the base.

4. The assembly according to claim 1 wherein the base further comprises a pair of side members protruding outwardly in laterally opposing directions at a bottom end of the anchor post so as to be arranged to be engaged upon the surface of the ground at laterally opposing sides of a vertical plane containing the anchor post therein when the anchor post is slidably supported on the anchor pin.

5. The assembly according to claim 1 for a fence in which the fencing material comprises a plurality of fence wires spanning under tension at different elevations, the assembly further comprising a plurality of wire mounting locations formed on the anchor post at spaced positions along the post axis upon which respective ones of the fence wires are arranged to be supported at the different elevations.

6. The assembly according to claim 1 further comprising an auxiliary post mounted at an outer side of the anchor post and oriented transversely to the anchor post such that the auxiliary post is arranged to be vertically oriented within a common vertical plane with the anchor post when the anchor post is slidably supported on the anchor pin.

7. The assembly according to claim 6 wherein a bottom end of the auxiliary post and a bottom end of the anchor post lie in common horizontal plane defining the bottom side of the base of the frame.

8. The assembly according to claim 6 wherein the auxiliary post comprises a hollow tube extending between opposing open ends and wherein the assembly further comprises an auxiliary pin arranged to be slidably received through the hollow tube of the auxiliary post and penetrated into the ground to secure the auxiliary post relative to the ground.

9. The assembly according to claim 6 further comprising a plurality of crossbars within a common plane of the auxiliary post and the anchor post which connect between the auxiliary post and the anchor post at respective different elevations.

10. A fence for extending along a fenced boundary, the fence comprising:

a plurality of fence posts supported in the ground at spaced apart locations along a fenced boundary;

a fencing material joined to the fence posts so as to extend under tension along the fenced boundary; and an anchor fence post assembly comprising:

a frame including a base having a bottom side engaged upon a surface of the ground and an anchor post fixed relative to the base which couples the fencing material thereon, the anchor post extending non-perpendicularly upwardly from a plane of the bottom side of the base such that a post axis of the anchor post is oriented to extend upwardly at an outward slope away from tension of the fencing material with the bottom side of the base being engaged substantially horizontally upon the surface of the ground; and an anchor pin arranged to be penetrated into the ground along the post axis and coupled to the frame such that the frame is slidable relative to the anchor pin and the ground along the post axis.

11. The fence according to claim 10 wherein the anchor post comprises a hollow tube receiving the anchor pin slidably through opposing open ends of the hollow tube.

12. The fence according to claim 10 wherein the base of the anchor fence post assembly includes a base member extending outwardly from a bottom end of the anchor post within a plane lying at an obtuse angle to the anchor post such that the base member is engaged substantially horizontally on a surface of the ground when the anchor post is slidably supported on the anchor pin.

13. The fence according to claim 10 wherein the base of the anchor fence post assembly includes a pair of side members protruding outwardly in laterally opposing directions at a bottom end of the anchor post so as to be engaged upon a surface of the ground at laterally opposing sides of a vertical plane containing the anchor post therein when the anchor post is slidably supported on the anchor pin.

14. The fence according to claim 10 wherein the fencing material comprises a plurality of fence wires spanning under tension at different elevations, and the anchor fence post assembly comprises a plurality of wire mounting locations formed on the anchor post at spaced positions along the anchor post upon which respective ones of the fence wires are supported at the different elevations.

15. The fence according to claim 10 wherein the anchor fence post assembly further comprises an auxiliary post mounted at an outer side of the anchor post and oriented transversely to the anchor post such that the auxiliary post is arranged to be vertically oriented within a common vertical plane with the anchor post when the anchor post is slidably supported on the anchor pin.

16. The fence according to claim 15 wherein a bottom end of the auxiliary post and a bottom end of the anchor post of the anchor fence post assembly lie in common horizontal plane defining the bottom side of the frame.

17. The fence according to claim 15 wherein the auxiliary post of the anchor fence post assembly comprises a hollow tube extending between opposing open ends and wherein the anchor fence post assembly further comprises an auxiliary pin arranged to be slidably received through the hollow tube of the auxiliary post and penetrated into the ground to secure the auxiliary post relative to the ground.

18. The fence according to claim 15 wherein the anchor fence post assembly further comprises a plurality of crossbars within a common plane of the auxiliary post and the anchor post which connect between the auxiliary post and the anchor post at respective different elevations.

19. The fence according to claim 18 wherein the fencing material comprises a plurality of fence wires spanning under tension at different elevations, each fence wire being supported on the anchor post at an intersection of a respective one of the crossbars with the anchor post.

20. A method of supporting a fence which includes a plurality of fence posts supported in the ground at spaced apart locations along the fenced boundary and fencing material joined to the fence posts so as to extend along the fenced boundary under tension, the method comprising:

providing an anchor fence post assembly on the fenced boundary spaced apart from the fence posts which includes an anchor post for coupling the fencing material thereon and an anchor pin for anchoring the anchor post relative to the ground;

penetrating the anchor pin into the ground such that the anchor pin extends along a post axis at an upward and outward slope which is offset from vertical away from a direction of tension of the fencing material;

supporting the anchor post on the anchor pin such that the anchor post is slidable along the post axis relative to the anchor pin; and coupling the fencing material to the anchor post.

* * * * *